United States Patent [19]

Regan et al.

[11] 4,053,814

[45] Oct. 11, 1977

[54] CONTINUOUS AUTOMATIC STARTING ASSIST UV CIRCUIT FOR MICROWAVE POWERED ELECTRODELESS LAMPS

[75] Inventors: Robert J. Regan, Needham; Paul O. Haugsjaa, Acton; William H. McNeill, Carlisle, all of Mass.

[73] Assignee: GTE Laboratories Incorporated, Waltham, Mass.

[21] Appl. No.: 705,328

[22] Filed: July 14, 1976

[51] Int. Cl.[2] ..... H05B 41/16; H05B 41/24

[52] U.S. Cl. ..... 315/248; 315/267; 315/344; 315/151; 315/158; 250/372; 250/504

[58] Field of Search ..... 315/248, 39, 151, 158, 315/159, 104, 267, 283, DIG. 7, 344, 149; 250/504, 372, 373

[56] References Cited

U.S. PATENT DOCUMENTS

| | | | |
|---|---|---|---|
| 3,142,758 | 7/1964 | Dietz | 250/372 |
| 3,196,312 | 7/1965 | Marrison | 315/248 X |
| 3,227,923 | 1/1966 | Marrison | 315/248 |
| 3,258,758 | 6/1966 | Byrd | 250/372 X |
| 3,377,507 | 4/1968 | Riebs | 315/149 X |
| 3,497,767 | 2/1970 | Guillon et al. | 315/344 X |
| 3,636,357 | 1/1972 | Del Zotto | 315/159 |
| 3,873,884 | 3/1975 | Gabriel | 315/267 |

*Primary Examiner*—Saxfield Chatmon, Jr.
*Attorney, Agent, or Firm*—Irving M. Kriegsman; Leslie J. Hart

[57] ABSTRACT

A starting assist control circuit for an electrodeless light source in which a UV source for assisting in starting an electrodeless lamp is coupled in series with the DC supply for a microwave power source for the lamp so that a reduced DC voltage is supplied to the microwave power source at lamp starting. An electronic circuit is provided which continuously decreases the DC current through the UV source and increases the DC voltage for the microwave power source in relation to the amount of light generated by the electrodeless lamp. More specifically, the emitter and collector of a transistor are coupled across the UV source to provide a shunt path and the potential of the base of the transistor is controlled by a photosensitive resistor which senses the amount of light from the lamp. As the lamp generates increased light, the transistor becomes more conductive, thereby continuously decreasing current to the UV source and increasing voltage to the microwave power source.

8 Claims, 3 Drawing Figures

CONTINUOUS AUTOMATIC STARTING ASSIST UV CIRCUIT FOR MICROWAVE POWERED ELECTRODELESS LAMPS

CROSS-REFERENCE TO RELATED APPLICATIONS

A concurrently filed application entitled "Automatic Starting System for Solid State Powered Electrodeless Lamps" bears Attorney's Docket No. D-1243, Ser. No. 705,323, is assigned to the same assignee herein, and is filed in the name of William H. McNeill, Paul O. Haugsjaa, Joseph Lech and Robert J. Regan. Also, a concurrently filed application entitled "Solid State Microwave Power Source For Use In An Electrodeless Light Source" bears Attorney's Docket No. D-1241, Ser. No. 705,324, is assigned to the same assignee herein, and is filed in the name of Robert J. Regan, Paul O. Haugsjaa and William H. McNeill.

BACKGROUND OF THE INVENTION

The present invention relates to microwave excited electrodeless light sources and, more specifically, to an automatic starting control circuit for an electrodeless lamp powered by a solid state microwave source.

There has recently been developed a light source in which an electrodeless lamp is disposed at the ends of inner and outer conductors of a fixture in which the lamp forms a termination load for microwave power supplied at the other end of the conductors. There has also been developed various types of starting assist devices for this type of light source. The need for a starting assist is due to the high impedance mismatch between the lamp in the off state and the output impedance of the power source which results in a low percentage of the forward directed power being absorbed by the lamp. In one starting scheme, the fixture is made to be in a condition of resonance at starting to increase the power absorbed by the lamp. In another scheme, a UV light source is used to supply a flux of UV photons to the lamp. Both schemes have functioned satisfactorily in providing a starting assist. In both starting assist devices, the operator must manually disconnect the devices after the lamp is started. There exists a need for automatic connecting and decoupling of these devices if the electrodeless light source is to have enhanced versatility. It has also been found that a solid state microwave power source, when operated at its full rated power dc supply voltage, can not tolerate running into large impedance mismatches such as occur when the source is coupled to a lamp in the off state. A means of controlling this supply voltage during the lamp start-up is necessary.

SUMMARY OF THE INVENTION

It is an object of the present invention to provide a continuous increase in power applied to a microwave powered electrodeless lamp from the initial turn-on level to the full running power level as a function of electrodeless lamp output and further to do so in such a way to prevent the microwave power source from being subjected to excessive standing waves due to mismatched load impedances.

It is an additional object of the present invention to provide an electronically controlled bypass around a UV light source when its presence is no longer required, such as when the electrodeless lamp is running.

According to the present invention, there is provided a starting control circuit for use in an electrodeless light source having a source of power at a microwave frequency, an electrodeless lamp with an envelope made of a light-transmitting material and a volatile fill material emitting light upon breakdown and excitation and a termination fixture having an inner conductor and an outer conductor disposed around the inner conductor, the lamp being disposed at one end of the conductors so as to form a termination load for the microwave power coupled to the other end of the conductors. The power source includes a dc power source and a microwave power source receiving the dc power for providing microwave power in an amount related to the amount of dc power, the microwave power source output being coupled to the inner and outer conductors. A switch is provided for controlling the application of dc power to the microwave power source. In addition, a UV light source is disposed near the lamp and coupled in series between the dc power source and the microwave power source to emit UV light upon activation of the switch to assist in starting the lamp. The UV source upon emission of light decreases the amount of dc power applied to the microwave power source to reduce the output thereof. Accordingly, a device is provided for continuously decreasing the dc current through the UV source and increasing the dc voltage applied to the microwave power source in relation to the amount of light generated within the fixture as the lamp is started. The device for decreasing the current and increasing the voltage includes a transistor device coupled between the dc power source and the microwave power source and across the UV source to provide a shunt path therearound whose impedance is a function of the state of conduction of the transistor device. A light sensitive device responsive to the light from the lamp controls the conductive state of the transistor means to regulate the dc power to the microwave power source in direct relation to the amount of light from the lamp.

DESCRIPTION OF PREFERRED EMBODIMENTS

Figure 1:
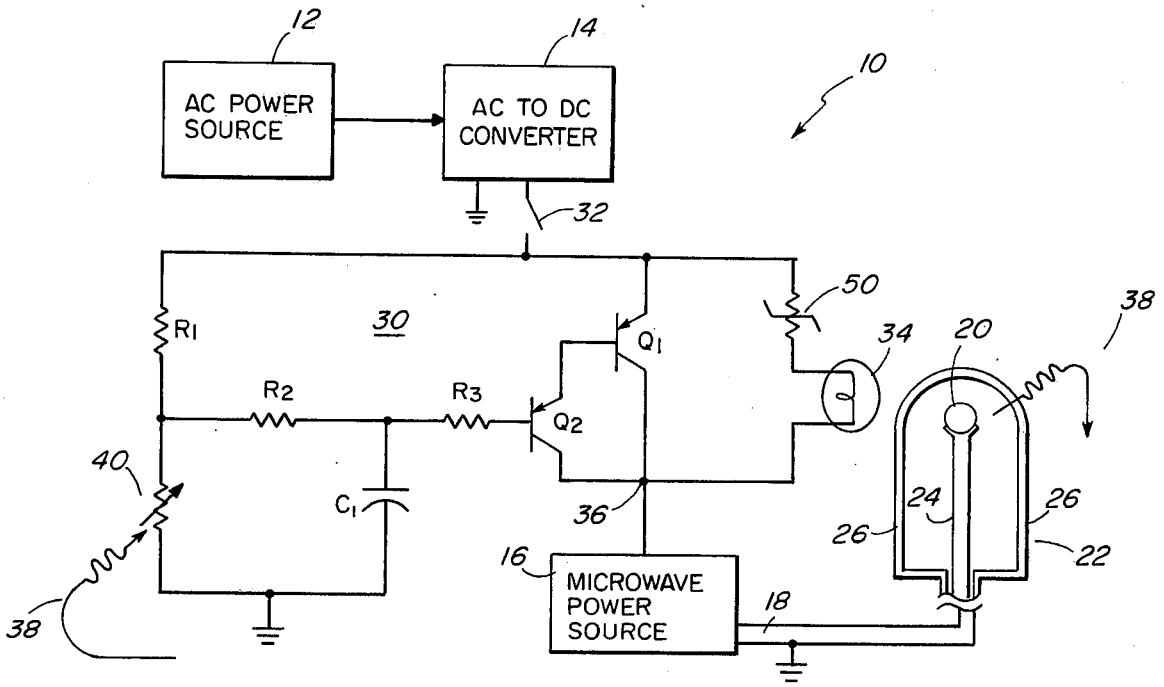
FIG. 1 is a diagram of a starting control circuit according to the present invention.

In an exemplary embodiment of the present invention, as illustrated in FIG. 1, there is provided an electrodeless light source, represented generally by the reference numeral 10. The light source 10 includes a source of power at a microwave frequency. As used herein, microwave frequency is intended to include frequencies in the range of 10 MHz to 300 GHz. The power source includes a source of dc power, such as an ac source 12 whose output is coupled to an ac to dc converter 14, and a microwave power source 16 which receives the dc power from the converter 14 for providing microwave power in an amount related to the output of the dc power. The light source 10 has an electrodeless lamp 20 having an envelope made of a light-transmitting material, such as quartz, and a volatile fill material which emits light upon breakdown and excitation. A termination fixture represented generally by the reference numeral 22 has an inner conductor 24 and an outer conductor 26 disposed around the inner conductor 24. The lamp 20 is disposed at one end of the conductors to form a termination load for the microwave power, which is coupled to the other end of the conductors. The source 16 preferably includes a solid state microwave oscillator and a solid state microwave amplifier. Additional details of one suitable power source may be found in the previously mentioned patent application entitled "Solid State Microwave Power Source For Use In An Electrodeless Light Source." The source described in this application includes an oscillator, in which a transistor is the active element of a class "C" modified Colpitts type of common base oscillator, a transistorized class "C" power amplifier, and an impedance matching circuit utilizing microstrip elements coupled to the output of the amplifier and the conductors 24 and 26 of the fixture 22 for providing an acceptable impedance transformation from the fixture 22 to the collector of the power transistor and for providing a sufficient amount of power to the lamp during the starting mode. The output of the microwave power source 16 is coupled via a transmission line 18, such as a microstrip, to the inner and outer conductors 24 and 26.

A starting control circuit, represented generally by the reference numeral 30, has a switch 32 for controlling the application of dc power to the microwave power source 16. A UV light source 34 is disposed near the lamp 20 and is coupled in series between the dc power source 14 and the microwave power source 16. The source 34 emits UV light upon activation of the switch 32 to assist in starting the lamp. Also, the UV source 34 upon emission of light decreases the amount of dc power coupled to the microwave power source to reduce its output. According to the invention, a device is provided for continuously decreasing the dc current through the UV source 34 and increasing the dc voltage at a point 36 for the microwave power source 16 in relation to the amount of light represented at 38 generated within the fixture 32 as the lamp 20 is warming up. This is accomplished by a transistor device coupled between the dc power source and the microwave power source 16 and across the UV source 34 to provide a shunt path around the source 34. The impedance of the shunt path is a function of the state of conduction of the transistor. Light sensitive means 40, such as a photoconductive resistor, is responsive to the light 38 from the lamp for controlling the conductive state of the transistor device to regulate the dc power to the microwave power source.

The transistor device includes a first transistor Q1 whose emitter and collector are coupled in series between the dc power source 14 and the microwave power source 16. Transistor Q1 is also coupled in parallel with respect to the UV source 34. A biasing network for the transistor Q1 includes the transistor Q2 whose emitter is coupled to the base of Q1 and whose collector is coupled to the input of the microwave power source 16. A base biasing network for the base of transistor Q2 includes a resistor R1 coupled in series with the photosensitive resistor 40 between the output of the converter 14 and ground. The junction of these elements is coupled to one side of a resistor R2 whose other side is coupled in series to a resistor R3. The other side of R3 is in turn coupled to the base of Q2. A capacitor C1 coupled between ground and the junction of resistors R2 and R3 forms a shunt path around the base circuit of Q2 for inhibiting transient variations in light output from effecting the conductive state of Q2 and Q1.

The following describes the operation of the starting control circuit. Prior to the lamp 20 initiating light, the value of the light sensitive resistor 40 is such as to cause the transistor Q2 to be non-conductive, the output voltage of the converter 14 being positive with respect to ground. Q1 is also non-conductive at this time. After the switch 32 is closed, current flows through the source 34 providing an adequate voltage at 36 to cause the power source 16 to provide an output. The combined effect of power source 16 providing some microwave power and of the output of the light source 34 providing UV to lamp 20 initiates the starting of the lamp 20. As the lamp 20 emits light 38, the resistance of the light sensitive resistor 40 decreases, thereby forward biasing the base-to-emitter junction of transistor Q2. As transistor Q2 becomes more conductive, the base-to-emitter junction of transistor Q1 becomes forward biased, thereby causing a current path from the emitter to collector of Q2.

In another feature of the present invention, a device which is responsive to heat generated within the termination fixture 22 is provided for decreasing current through the source 34 in relation to the heat in the fixture as the lamp is started and as microwave power is absorbed within the fixture. In FIG. 1, the heat responsive device includes a positive temperature coefficient resistor 50 in series with the UV source 34. The resistor 50 is physically disposed in relation to the fixture so as to have a value of resistance in direct relation to heat within the fixture. As the lamp warms up, resistor 50 increases its resistance thereby decreasing the current to the UV source 34. Also, as the level of light 38 increases, the photoresistor 40 and the transistor Q2 cause the transistor Q1 to conduct more, until a point is reached when Q1 saturates. When this occurs, Q1 essentially becomes a short circuit across the resistor 50 and the UV lamp 34. The resistor 50 is by this time a very large resistance and the UV lamp, due to lack of current, is off. The full voltage from the dc converter 14 is now applied to the microwave power source and the electrodeless light source 10 is running optimally.

The following indicates the identification and value of the various components shown in FIG. 1.

| | |
|---|---|
| R1 | 37 ohms |
| R2 | 59K ohms |
| R3 | 10K ohms |
| C1 | 30μf |
| Q1 | 2N1531 |
| Q2 | 2N6040 |
| Photoresistor 40 | CL5M4L Clairex |
| PTCR | Sylvania MS-4000 series |
| UV lamp 34 | Tungsten-halogen incandescent lamp |

Figure 2:
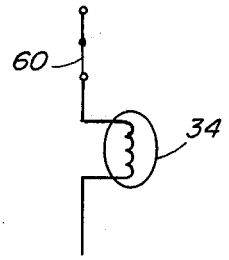
FIG. 2 is an alternative embodiment of a starting control circuit.

FIG. 2 is an alternative embodiment of the UV lamp circuit of FIG. 1 in which the positive temperature coefficient resistor 50 is replaced by a normally closed bimetallic switch 60. Switch 60 is physically disposed within the fixture 22 and is made of two strips of metal having different coefficients of thermal expansion. In operation, when a certain level of heat is sensed by the switch, it opens thereby inhibiting current flow to the UV lamp 34.

Figure 3:
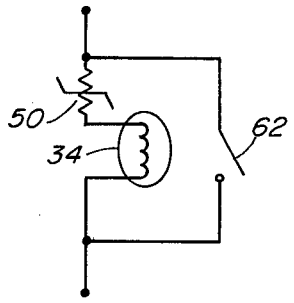
FIG. 3 is another alternative embodiment of a starting control circuit.

FIG. 3 is another alternative embodiment of the UV lamp circuit of FIG. 1 in which a normally open bimetallic switch 62 is coupled in parallel across the resistor 50 and the lamp 34. Switch 62 is physically disposed within the fixture 22 so that when a certain level of heat is sensed by the switch, the switch closes. This embodiment has the advantage of reducing the power consumption of transistor Q1 when it is saturated.

The embodiments of the present invention are intended to be merely exemplary and those skilled in the art shall be able to make numerous variations and modifications of them without departing from the spirit of the present invention. For example, the photocontroller 40 could be either a phototransistor, photocell or any other light sensitive component which has electrical characteristics sufficient to provide control of the action of a transistor. Also, while in FIG. 1 there is shown PNP type transistors, it is of course understood that the same operation could be obtained with the use of NPN type transistors with the photocontroller in the appropriate position for proper control. More specifically, the positions of the photocontroller 40 and the resistor R1 would be interchanged. All such variations and modifications are intended to be within the scope of the present invention as defined by the appended claims.

We claim:

1. In an electrodeless light source having a source of power at a microwave frequency, an electrodeless lamp with an envelope made of a light-transmitting material and a volatile fill material emitting light upon breakdown and excitation and a termination fixture having an inner conductor and an outer conductor disposed around the inner conductor, the lamp being disposed at one end of the conductors to form a termination load for the microwave source coupled to the other end of the conductors, a starting control circuit including:

a. the source including a dc power source and a microwave power source receiving the dc power for providing microwave power in an amount related to the amount of dc power, the microwave power output being coupled to the inner and outer conductors, b. switch means for controlling the application of dc power to the microwave power source, c. a UV light source disposed near the lamp and coupled in series between the dc power source and the microwave power source to emit UV light upon activation of the switch means to assist in starting the lamp, the UV source upon emission of light decreasing the amount of dc power coupled to the microwave power source to reduce the output thereof, d. means for continuously decreasing the dc current through the UV source and increasing the dc voltage for the microwave power source in relation to the amount of light generated within the fixture as the lamp is started, e. transistor means coupled between the dc power source and microwave power source and across the UV source to provide a shunt path therearound whose impedance is a function of the state of conduction of the transistor means, and f. light sensitive means responsive to the light from the lamp for controlling the conductive state of the transistor means to regulate the dc power applied to the microwave power source in direct relation to the amount of light from the lamp.

2. The circuit according to claim 1 further including means for inhibiting transient variations in light output from the lamp from effecting the conductive state of the transistor means.

3. The circuit according to claim 2 wherein the transistor means includes:

a. a first transistor whose collector and emitter are coupled in series between the dc power source and the microwave power source and in a parallel coupling relationship with respect to the UV source, and b. base biasing network means for the first transistor, the network having a second transistor whose emitter and collector are coupled between the dc input of the microwave power source, and the base of the first transistor and a resistive bias means for the base of the second transistor, the bias means including a photosensitive resistor for controlling the conductive state of the first and second transistors.

4. The circuit according to claim 3 wherein the light transient inhibiting means includes a capacitor forming a shunt path with respect to the base of the second transistor for inhibiting light output transients from effecting the conductive state of the transistors.

5. The circuit according to claim 1 further including means responsive to heat generated within the fixture for decreasing the dc current to the UV source in relation to the heat in the fixture as the lamp is started and as microwave power is absorbed within the fixture.

6. The circuit according to claim 5 wherein the heat responsive means includes a positive temperature coefficient resistor means coupled in series with the UV source and physically disposed in relation to the fixture so as to have a value of resistance in direct relation to the heat sensed thereby.

7. The circuit according to claim 5 wherein the heat responsive means includes bimetallic switch means coupled in series with the UV source and physically disposed in relation to the fixture so as to decouple dc current to the UV source when the temperature reaches a predetermined level.

8. The circuit according to claim 5 further including bimetallic switch means coupled in parallel with respect to the series coupling of the UV source and heat responsive means so as to provide a shunt path around the transistor means when a predetermined temperature is sensed within the fixture.

* * * * *